United States Patent [19]

Martin

[11] 4,446,923

[45] May 8, 1984

[54] REMOVAL OF EXPLOSIVE OR COMBUSTIBLE GAS OR VAPORS FROM TANKS AND OTHER ENCLOSED SPACES

[75] Inventor: Roy T. Martin, Kingston-Upon-Thames, England

[73] Assignee: Walter Kidde & Co., Inc., Wake Forest, N.C.

[21] Appl. No.: 272,040

[22] Filed: Jun. 9, 1981

Related U.S. Application Data

[63] Continuation of Ser. No. 34,566, Apr. 30, 1979, abandoned, which is a continuation-in-part of Ser. No. 733,337, Oct. 18, 1976, abandoned, which is a continuation-in-part of Ser. No. 478,223, Jun. 11, 1974, abandoned.

[51] Int. Cl.[3] ..... A62C 1/14; A62C 1/12; A62C 3/12; A62D 1/02

[52] U.S. Cl. ..... 169/45; 169/66; 252/3; 252/8.05; 252/307; 252/605

[58] Field of Search ..... 252/3, 8.05, 605; 169/66, 45; 134/24; 422/40

[56] References Cited

U.S. PATENT DOCUMENTS

| | | | |
|---|---|---|---|
| 1,926,395 | 9/1933 | Midgley, Jr. | 252/3 X |
| 3,479,286 | 11/1969 | Gambaretto et al. | 252/3 X |
| 3,533,473 | 10/1970 | Jamison | 169/44 |
| 3,609,074 | 9/1971 | Rainaldi et al. | 252/3 |
| 3,620,306 | 11/1971 | Shepherd | 169/15 |
| 3,656,553 | 4/1972 | Rainaldi et al. | 252/3 X |
| 3,684,018 | 8/1972 | Rainaldi et al. | 252/3 X |
| 3,780,812 | 12/1973 | Lambert | 169/15 |
| 3,826,764 | 7/1974 | Weber | 252/5 X |

FOREIGN PATENT DOCUMENTS

| | | | |
|---|---|---|---|
| 1297260 | 6/1969 | Fed. Rep. of Germany | 252/606 |
| 2120755 | 11/1972 | Fed. Rep. of Germany | 169/66 |
| 46-35481 | 10/1971 | Japan | 252/3 |
| 7107052 | 11/1971 | Netherlands | 169/66 |
| 984407 | 2/1965 | United Kingdom | 252/3 |
| 1356945 | 6/1974 | United Kingdom | 169/66 |

OTHER PUBLICATIONS

Adamson: "Physical Chemistry of Surfaces", 2d Edition, p. 531, Interscience Publishers (1967).

*Primary Examiner*—Richard D. Lovering
*Attorney, Agent, or Firm*—Darby & Darby

[57] ABSTRACT

A method of purging an enclosed space of an explosive or combustible gas or vapor comprises filling the space with a foam the bubbles of which are filled with a preprepared gaseous mixture of air and a non-toxic fire-suppressant gas, such as bromotrifluoromethane, in predetermined proportions and allowing the foam to decay. The proportions of air and said fire-suppressant gas in the gaseous mixture are such that when the foam decays the gaseous mixture remaining in the tank and freed by the decay of the foam is capable of supporting human life.

12 Claims, No Drawings

REMOVAL OF EXPLOSIVE OR COMBUSTIBLE GAS OR VAPORS FROM TANKS AND OTHER ENCLOSED SPACES

This invention relates to the removal of explosive or combustible gas or vapor from tanks or other enclosed spaces, and the present application is a continuation of Ser. No. 034,566, filed Apr. 30, 1979, now abandoned, which is a continuation-in-part of Ser. No. 733,337, filed Oct. 18, 1976, now abandoned, which in turn is a continuation-in-part of Ser. No. 478,223, filed June 11, 1974, now abandoned.

According to this invention, there is provided a method of purging an enclosed space of a flammable substance in a gaseous state comprising forming a foam whose bubbles are filled with a pre-prepared fire-suppressant mixture of predetermined proportions of air and a fire-suppressant substance of low toxicity in gaseous form, introducing the foam into said enclosed space and allowing the foam to decay in said enclosed space, the gaseous mixture remaining after the foam decays being capable of supporting human life.

The preferred fire suppressant gas is bromotrifluoromethane but certain other gases, such as bromochlorodifluoromethane, trichlorofluoromethane, dichlorodifluoromethane, chlorotrifluoromethane, tetrafluoromethane, chlordifluoromethane, trifluoromethane and dichlorofluoromethane can also be used. The foam is preferably a high or medium expansion foam.

Any suitable conventional apparatus can be used to fill the foam bubbles with the fire-suppressant materials. Apparatus and methods for filling foam bubbles are well known to those skilled in the art and are exemplified, for example, by Jamison, U.S. Pat. No. 3,533,473; O'Regan et al U.S. Pat. No. 3,512,761; British Pat. No. 1,238,761; German Pat. No. 1,434,929; and French Pat. No. 1,587,291. Generally speaking, the method used by those skilled in the art is that a motor-driven fan produces a rapid flow of air through a short tube of substantial diameter across which extends a screen of wire mesh. Water containing a foaming agent is sprayed onto this mesh so that large quantities of foam are produced and pushed toward a target. In a preferred embodiment of the invention, to introduce gaseous bromotrifluoromethane into the bubbles, bromotrifluoromethane being gaseous at temperatures exceeding −57.8° C. and therefore gaseous at temperatures normally encountered, the known method is used but bromotrifluoromethane is introduced into the air stream upstream of the fan, so that the fan mixes the gas with the air. The gas is conveniently introduced into the air stream in the tube through nozzles at a rate which is adjustable so as to provide a mixture in which the proportion of bromotrifluoromethane to air in the bubbles of the foam has a predetermined value which may be in the range 2 to 12%. The fan is used to push the foam into the enclosed space which is to be purged, so as completely to fill the space.

In use, for example, where the mixture is supplied to the interior of a tank, the bubbles physically displace the explosive or combustible gas or vapour and it is found that any incipient flame is actively chemically inhibited by the bromotrifluoromethane. Even if local heating is applied to the tank, as by a cutting torch during repair or dismantling of the tank, ignition is prevented by the local release of the fire-suppressant substance from bubbles broken down by the heat. The foam ensures that the whole volume within the tank is purged and protected, and prevents or minimizes losses through any leakage points, and when the foam has been allowed to decay the tank can safely be worked in. It is of course necessary to exclude excess air from the tank while the tank is being so worked in, if the work is such as to incur the risk of an explosion in order not to dilute the bromotrifluoromethane.

The ratio of fire-suppressant substance to air in the bubbles is varied according to the flammable material which has been contained in the tank, and according to the fire-suppressant qualities of the substance. The substance must however be gaseous at standard temperature and pressure (i.e. 0° C. and 30 mm Hg. pressure) and should preferably have at least a substantial vapour pressure at 0° C., since otherwise it may be of limited use when the ambient temperature is low.

The present method is greatly superior to a method in which a tank is filled with foam composed of bubbles containing an inerting mixture of air with an inert gas such as nitrogen or carbon dioxide. Only a small quantity of the fire-suppressant need be inserted in the tank in comparison with the amounts of nitrogen and carbon dioxide which would be required. For example, if nitrogen is to be used for preventing kerosene from burning in a tank at least 50% of the air in the tank must be replaced by nitrogen. Using carbon dioxide to replace the air, the volume of air replaced would have to be approximately 30%. Using bromotrifluoromethane as the fire-suppressant in a method according to the present invention, the volume of air which it is necessary to replace is reduced to 2.8%. Thus if the entire air content of a tank which has contained kerosene and which is to be purged is replaced by foam bubbles filled with a mixture of 97.2% air and 2.8% bromotrifluoromethane by volume, the burning of any remnant of kerosene in the tank will be suppressed. Similarly, the proportion of bromotrifluoromethane required to deal with conditions where the substance causing the danger is known can be predetermined. Where the substances to be prevented from burning are propane and carbon disulphide the quantities of air to be replaced by bromotrifluoromethane are 6.6% and 12% respectively by volume.

The amounts of fire-suppressant which it is necessary to use are not so hazardous as would be the case with the amounts of nitrogen or carbon dioxide required to obtain equivalent control of a potential source of fire or explosion in an enclosed space, in that there is no risk, or there is a greatly reduced risk, of suffocation to personnel working in pits, ships holds and other confined spaces. This is because the levels of inert gas required to control ignition are so high that the resulting air/gas mixture will not support human life, whereas the required levels of bromotrifluoromethane are much less dangerous and permit the entry of personnel to the tank. It will be understood that after the foam has decayed, the danger of asphyxiation which arises where personnel enter a tank which has been purged by using nitrogen or carbon dioxide is not readily apparent.

I claim:

1. A method of purging an enclosed space of a gaseous flammable substance comprising:

(a) forming a foam from (i) a liquid consisting essentially of water and a foaming agent and (ii) a human life-supporting, fire-suppressing gaseous mixture consisting essentially of predetermined quantities of air and a low-toxicity fire-suppressant gaseous substance, said gaseous mixture filling the bubbles of said foam, said foam being capable of decaying;

(b) introducing said foam into said enclosed space, thereby displacing said flammable substance; and (c) allowing the foam to decay in said enclosed space.

2. The method according to claim 1, wherein the fire-suppressant substance in the mixture is bromotrifluoromethane.

3. The method according to claim 2, wherein the proportion of bromotrifluoromethane in the mixture is approximately 2.8 percent by volume.

4. The method according to claim 2, wherein the proportion of bromotrifluoromethane in the mixture is approximately 6.6 percent by volume.

5. The method according to claim 2, wherein the proportion of bromotrifluoromethane in the mixture is approximately 12 percent by volume.

6. The method according to claim 1, wherein the fire-suppressant substance is bromochlorodifluoromethane.

7. A method as described in claim 1 wherein said fire-suppressant substance is selected from the group consisting of trichlorofluoromethane, dichlorodifluoromethane, chlorotrifluoromethane, tetra fluoromethane, chlordifluoromethane, trifluoromethane and dichlorofluoromethane.

8. A method of purging an enclosed space of a gaseous flammable substance comprising:

(a) spraying a mixture consisting essentially of water and a foaming agent onto a mesh screen;

(b) mixing a gaseous, low-toxicity fire-suppressant substance and air in predetermined proportions to form a human life-supporting fire-suppressant gaseous mixture;

(c) propelling said gaseous mixture through said mesh screen to form a foam;

(d) filling said enclosed space with said foam, thereby displacing said flammable substance; and (d) allowing said foam to decay in said enclosed space.

9. A method as described in claim 8, wherein the gaseous, fire-suppressant substance is bromotrifluoromethane.

10. A method as described in claim 9 wherein the proportion of bromotrifluoromethane to air in the gaseous mixture is from about 2% to about 12% by volume.

11. A method as described in claim 8, wherein the gaseous, fire-suppressant substance is bromochlorodifluoromethane.

12. A method of purging an enclosed space of a gaseous flammable substance comprising:

(a) forming a decaying foam from a liquid consisting essentially of water and a foaming agent and a human life-supporting, fire-suppressant gaseous mixture consisting essentially of air and a low toxicity fire-suppressant gaseous substance mixed at predetermined proportions;

(b) filling said enclosed space with said foam; and (c) allowing the foam to decay in said enclosed space.

* * * * *